United States Patent [19]

Holca

[11] 4,436,605

[45] Mar. 13, 1984

[54] BIPOLAR ELECTRODE ELECTROLYSIS APPARATUS

[75] Inventor: Radu Holca, Boulogne, France

[73] Assignee: Degremont, Rueil Malmaison, France

[21] Appl. No.: 372,238

[22] Filed: Apr. 26, 1982

[51] Int. Cl.[3] ..... C25D 17/00; C25B 15/00; C25B 9/02; C25B 11/10

[52] U.S. Cl. ..... 204/225; 204/268; 204/228; 204/286; 204/290 F

[58] Field of Search ..... 204/267–270, 204/290 F, 225, 286, 288, 228

[56] References Cited

U.S. PATENT DOCUMENTS 4,060,475 11/1977 Fournier et al. ..... 204/270
4,118,294 10/1978 Pellegri ..... 204/270 X
4,203,821 5/1980 Cramer et al. ..... 204/268
4,332,648 6/1982 Spore ..... 204/270 X

*Primary Examiner*—Donald R. Valentine
*Attorney, Agent, or Firm*—Wenderoth, Lind & Ponack

[57] ABSTRACT

In a bipolar electrode electrolysis apparatus, particularly for the electrolysis of saline solutions, an enclosure is formed of electrically insulating material and has monopolar terminal electrodes for connection to current leads. The enclosure has therein a plurality of compartments having open sides through one wall of the enclosure. A plurality of bipolar electrodes are mountable in each compartment. The bipolar electrodes are mounted by supporting structure in each respective compartment so that the bipolar electrodes may be removed from and inserted into a respective compartment through the open side thereof.

13 Claims, 4 Drawing Figures

BIPOLAR ELECTRODE ELECTROLYSIS APPARATUS

BACKGROUND OF THE INVENTION

The present invention relates to an electrolysis apparatus, particularly for the electrolysis of saline solutions. More specifically, the present invention is directed to an electrolysis apparatus of the type including an enclosure of insulating material and having monopolar terminal electrodes for connection to current leads and a plurality of bipolar electrodes, such apparatus being particularly useful for the electrolysis of saline solutions to obtain sodium hypochlorite, a powerful oxidizing agent employable for disinfecting of all types of water.

There are known many electrolysis devices utilizing various types of bipolar electrode assemblies for industrial use to achieve various electrochemical reactions from pure electrolytes. Such known electrolyzers however are poorly adapted to and have many serious disadvantages when the electrolyte is a natural, unpurified solution. This is particularly true in the case of unpurified sea water, brackish water or brine, by the electrolysis of which it is desired to obtain a diluted solution of sodium hypochlorite. In known electrolyzers employing unpurified electrolytes, the electrodes wear out more or less quickly and unevenly. It then becomes necessary to detect the failing electrodes and to replace them. However, the design of such known electrolyzers is such the changing failing electrodes requires that the electrolyzers be completely dismantled.

SUMMARY OF THE INVENTION

With the above discussion in mind, it is the object of the present invention to provide an improved bipolar electrode electrolysis apparatus, particularly for the electrolysis of saline solutions, whereby the disadvantages of prior electrolyzers are overcome and whereby it is possible, without any dismantling of the overall electrolyzer structure, to enable the quick and easy replacement of failing electrodes. Since the electrolysis apparatus of the present invention allows for the quick and easy replacement of failing bipolar electrodes, the present invention lends itself to the use of bipolar electrodes which are more susceptible to consumption, and hence are more economical, than bipolar electrodes employed in conventional electrolyzers of this type. Furthermore, the present invention allows for the continuous monitoring of the operating conditions of the apparatus.

This object is achieved in accordance with the present invention by the provision of a bipolar electrode electrolysis apparatus, particularly for the electrolysis of saline solutions, including a frame formed of an electrically insulating material, and monopolar terminal electrodes to be mounted in the frame for connection to current leads. The frame has therein at least one compartment having an open side through one wall of the frame. A plurality of bipolar electrodes are provided and are supported within the compartment to allow removal and insertion of the bipolar electrodes through the open side of the compartment. The frame comprises a parallelepipedal enclosure defining therein a plurality of compartments vertically spaced from each other within the enclosure. The bipolar electrodes are supported within the compartment at equal intervals between the bipolar electrodes and between the monopolar terminal electrodes.

In accordance with one embodiment of the present invention, the bipolar electrodes are supported by members fixed to the frame, the members having recesses into which the bipolar electrodes are removably slideable. The recesses in the members are separated by projections of the members which space the bipolar electrodes at equal intervals parallel to each other and to the monopolar terminal electrodes. These members are formed of an electrically insulating material.

In accordance with a further embodiment of the present invention, the bipolar electrodes are supported on a box-shaped drawer device which is movably insertable into and removable from the compartment through the open side thereof. The drawer has spaced front and rear walls having therein grooves which are closed at lower ends thereof and open at upper ends thereof. The bipolar electrodes are insertable into and removable from the grooves through the upper open ends thereof when the drawer is removed from the compartment. The drawer may be slidably movable into and from the compartment along rails or grooves spaced on side walls of the frame. A cover may be fixed to the drawer to facilitate movement thereof into and from the compartment, the cover hermetically sealing the compartment when the drawer is positioned within the compartment. The drawer is formed of an electrically insulating material. A shunt provides electrical connection between the monopolar terminal cathode of the drawer and the corresponding current lead on the frame. The shunt may be connected to a control cabinet to enable continuous monitoring of the operation of the unit.

In accordance with a further aspect of the present invention, each bipolar electrode comprises a titanium body, for example a plate shaped body, having anode and cathode faces. The anode face includes a center portion covered with platinum and a peripheral border portion of oxidized titanium. The cathode face includes a peripheral border portion of the same width as the peripheral border of the anode face and covered with an electrically insulating material, for example such as polyamide, polyurethane, polyethylene, polytetrafluorethylene, or epoxies.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 4:
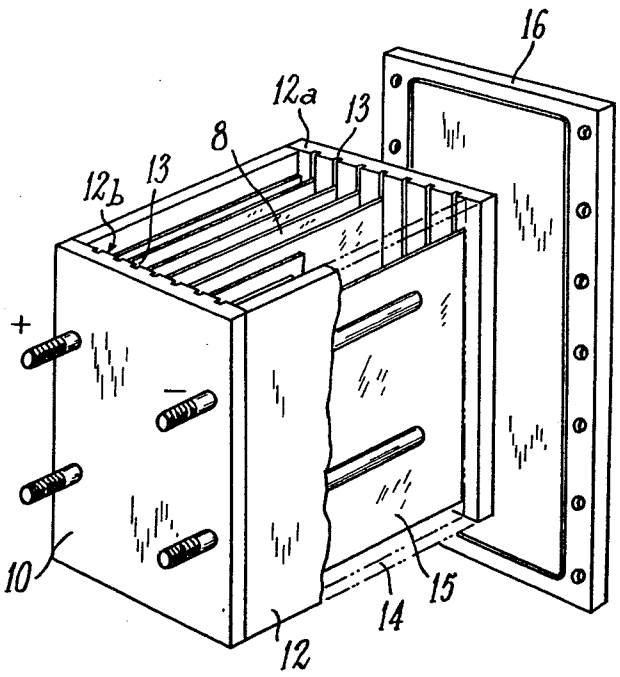
FIG. 4 is a perspective view, with portions broken away, of a box-shaped drawer structure employable in the embodiment of FIGS. 2 and 3.

All embodiments of the bipolar electrode electrolysis apparatus of the present invention include a vertically extending frame formed of an electrically insulating material, illustrated in the drawings as being a parallelepipedal enclosure 1 having a rectangular horizontal cross section. The enclosure 1 includes conventional features such as a lower chamber 2 for supply of an electrolyte through an inlet 3 and an upper chamber 4 as an outlet through an outlet duct 5 for the sodium hypochlorite solution produced in the direction of the system for the elimination of gases, mainly hydrogen, formed during the electrolysis operation and being found in supersaturation in such solution. Such system, not shown, is an air-stripping gas-liquid separator, advantageously equipped with a foam-damping vaporizer. Such features are conventional in this type of bipolar electrode electrolysis apparatus, and therefore such features are not described or illustrated herein in further detail, since those of ordinary skill in the art will readily understand such features.

In accordance with the apparatus of the present invention, monopolar terminal electrodes 6 are attached to side walls of enclosure 1. Current leads to terminal electrodes 6 pass through the side walls of the enclosure 1 and are connected to current lead bars 7 attached to the outer faces of the side walls of the enclosure. This relationship is shown in the embodiment of FIG. 1.

Figure 1:
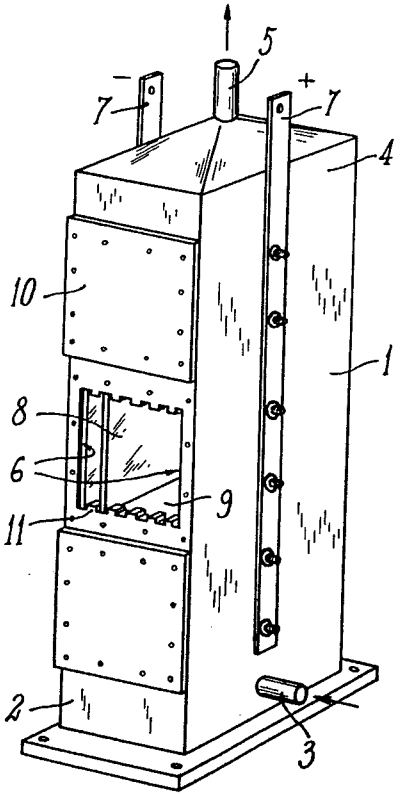
FIG. 1 is a perspective view from the front of an electrolysis apparatus in accordance with one embodiment of the present invention.

The enclosure 1 has therein at least one compartment 9, and preferably a plurality of vertically spaced compartments as shown in FIG. 1. The compartments are adapted to be closed, for example in a hermetically sealed manner, by means of front covers 10 which may be formed of a non-current conducting transparent material, for example PVC.

A plurality of bipolar electrodes 8 are supported within each compartment 9 in a manner such that, upon removal of the respective cover 10, bipolar electrodes 8 may be easily and quickly removed from and/or inserted into the respective compartment 9. In the embodiment of FIG. 1, the bipolar electrodes 8 are mounted in such fashion by members which are integral with front and rear walls of enclosure 1 and which have therein recesses into which the bipolar electrodes are removably slidable. The recesses are separated by projections 11 which space the bipolar electrodes 8 at equal intervals parallel to each other and to monopolar terminal electrodes 6. The members having the recesses and projections 11 are provided at the upper and lower portions of each compartment 9, as shown in FIG. 1. Such members may be, as shown in FIG. 1, integral with the respective walls of the enclosure 1, or may be separate elements fixed to such walls. Furthermore, additional members may be provided between the front and rear walls of the enclosure 1, should the bipolar electrodes be of a size to require additional support.

As will be understood by those skilled in the art, the electrolyte circulates from the bottom of the device to the top thereof between the electrodes.

The recesses and projections 11 are of a size to maintain the intervals between the bipolar electrodes equidistant, preferably at distances of from 2.5 to 5 mm.

In a bipolar electrode electrolyzer, it is useful to maintain equal intervals between adjacent electrodes as small as possible. This may be achieved by installing on the bipolar electrodes a number of flanges, not shown, of an insulating material distributed so as not to interfere with the insertion or removal of the electrodes. For example, odd numbered bipolar electrodes 8 might be provided with such flanges, and even numbered bipolar electrodes may be without such flanges. Such flanges also have the advantage of preventing the deformation of the bipolar electrodes and causing a turbulent flow of the electrolyte between the adjacent electrodes.

By the above structural arrangement, replacement of a failing electrode is very easy, since it is necessary only to remove the cover 10 of the compartment in which the particular failing electrode is found and to remove such failing electrode from the respective compartment through its open side. The mobility of the bipolar electrodes is assured by their being simply inserted into the recesses between the projections 11.

One of the most important advantages of the apparatus of the prevent invention is the simplicity of changing electrodes when necessary and the accessibility of such electrodes through the front of the apparatus. This makes it possible to limit the height of the overall electrolyzer. A defective or failing electrode easily may be detected through electronic monitoring of the operation of each compartment and the electrodes therein.

Figure 2:
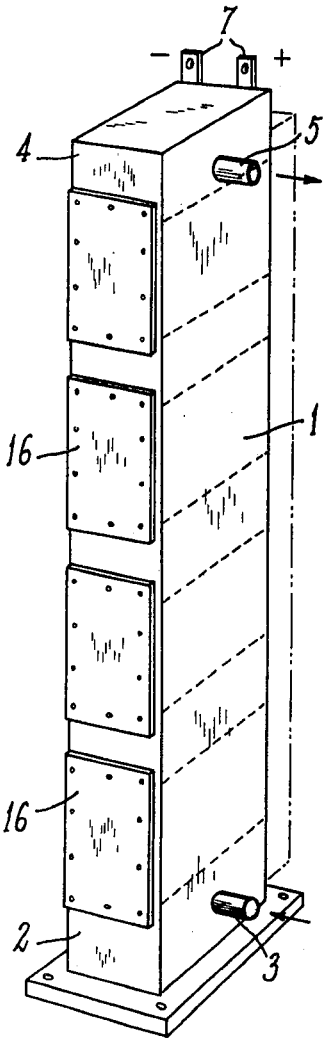
FIG. 2 is a view similar to FIG. 1, but of a second embodiment of the present invention.
Figure 3:
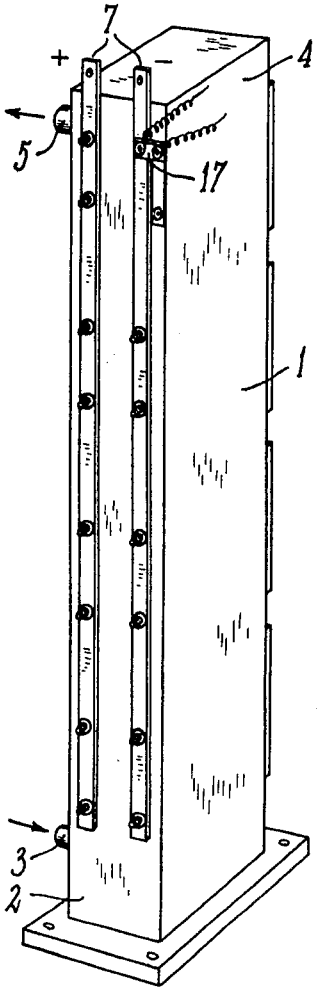
FIG. 3 is a perspective view of the apparatus of FIG. 2, but viewed from the rear thereof.

A second embodiment of the present invention is illustrated in FIGS. 2–4 of the drawings. In this embodiment, the structure supporting the bipolar electrodes in each compartment 9 in the enclosure 1 is in the form of a box-shaped drawer which is movably insertable into and removable from the respective compartment through the open side thereof. Each drawer 12 includes spaced front and rear walls **12*a*, 12*b* having therein vertically extending grooves 13 having lower ends closed, for example by abutments 14, and open upper ends. The bipolar electrodes are insertable into and removable from the grooves 13 in drawer 12 through the open upper ends of the grooves when the drawer 12 is removed from the respective compartment 9. Each drawer 12 may be slidably movable into and from the respective compartment 9 along grooves or rails, not shown, on the inner surfaces of the spaced side walls of enclosure 1. Each drawer 12 may have affixed thereto a respective cover 16, preferably formed of a transparent material, facilitating gripping and movement of the respective drawer into and from the compartment. The cover 16 closes the respective compartment 9, for example by hermetic sealing, when the drawer is positioned within the compartment. The drawer 12** is formed of an electrically insulating material.

The current leads 7 in this embodiment of the invention may be attached to the rear wall of the enclosure 1. The current leads 7 may be connected to the terminal electrodes of each drawer 12 by means of a shunt 17, shown in FIG. 3, which may be connected to a control cabinet allowing continuous monitoring of the proper operation of each compartment, in this case each drawer 12. Such arrangement constitutes an important advantage of this embodiment of the invention, since it makes it possible to quickly detect failure of any given bipolar electrode, thereby greatly facilitating operation of the electrolyzer.

Each drawer 12 is electrolytically autonomous within the electrolyzer and may be integrally replaced. The electrolyzer can be extended as necessary by superposition or juxtaposition of a plurality of additional drawers 12, the voltages at the posts of each drawer being identical. In the case of failure of a particular electrode in a particular drawer, such electrode may be exchanged, or the entire drawer may be exchanged, or such drawer simply may be removed, thereby enabling operation of the electrolyzer with the remaining drawers. The required number of spare bipolar electrodes thereby is reduced. Additionally, the apparatus of the present invention offers a remarkable flexibility of operation, since the apparatus of the present invention may continue to operate even with one or more compartments going out of service. Failure of a particular electrode easily may be detected by electronic monitoring of each drawer. Electrodes of any type may be employed in a single compartment or box. In addition, the apparatus of the present invention provides the possibility of adjusting at will the concentration of the solution produced by the apparatus by varying the electrolyte feed flow rate at a constant current density or by varying the current density at a constant electrolyte flow rate. For a given power per apparatus, the apparatus of the present invention operates at an overall higher voltage and at a lower current density than in known devices, thus reducing the cost of a transformer-rectifier used.

When an electrolysis cell equipped with bipolar electrodes, each of which operates on one face as a cathode and on the opposite face as an anode, it is found that the specific current composition expressed as kWh/kg of the product obtained is greater than that for a cell equipped with monopolar electrodes. It is also found that there is relatively fast wear of such electrodes. This is particularly the case with titanium bipolar electrodes.

These disadvantages are avoided in accordance with the present invention by covering the central portion of the anode face of the bipolar electrode with platinum surrounded by a peripheral border portion of oxidized titanium, such peripheral border portion having a width preferably of 15 to 20 mm, and by providing the cathode face of the bipolar electrode with a peripheral border portion of the same size as the peripheral border portion of the anode face and covered with a layer of electrically insulating material, such as polyamide, polyurethane, polyethylene, polytetrafluorethylene, epoxies, such layers preferably having a thickness of from 25 to 100$\mu$.

With this bipolar electrode configuration, a significant improvement is obtained in the specific consumption measured in kWh/kg of product, and the life of the bipolar electrode is substantially increased. This is emphasized by the following examples illustrating the merits of the apparatus according to the invention.

EXAMPLES 1 AND 2

A device generally according to the invention was employed to obtain sodium hypochlorite solution from sea water taken from a more or less polluted basin and having the following characteristics, which varied during the course of the tests:

| | | | |
|---|---|---|---|
| Concentration of Na | 7.90 | to | 10.00 g/l |
| Concentration of Ca | 0.38 | to | 0.42 g/l |
| Concentration of Mg | 1.10 | to | 1.24 g/l |
| Concentration of Cl | 17.40 | to | 18.90 g/l |
| Concentration of $SO_4$ | 2.25 | to | 2.85 g/l |
| pH | 7.6 | to | 8.1 |

The apparatus had two compartments in the form of drawers 12 which operated hydraulically serially and electrically parallel, each equipped with bipolar electrodes of titanium having a length of 320 mm and a thickness of 1 mm. The cathode face of each electrode was titanium, and the anode face of each electrode was platinum plated to the edges of the face. The unitary active surface was 1020 $cm^2$. In Example 1, the average distance between electrodes was 2.5 mm, and in Example 2 the distance was raised to 5 mm.

The results obtained are given in the following table:

| Current density ($A/cm^2$) | Example 1 kWh/kg (chlorine eq.) | Example 2 kWh/kg (chlorine eq.) |
|---|---|---|
| 0.05 | >8 | 7 |
| 0.10 | 6.2 | 6.3 |
| 0.15 | 6.0 | 6.9 |
| 0.20 | 6.0 | >8 |

EXAMPLES 3 AND 4

The same apparatus as employed in Examples 1 and 2 was operated under the same conditions, but employing bipolar electrodes according to the specific features of the present invention, wherein the cathode face of each electrode was of titanium with the four edges thereof covered with a polytetrafluorethylene film having a thickness of about 50$\mu$ and a width of about 15 mm. The anode side of each bipolar electrode was platinum plated in the central portion thereof, leaving a non-platinum plated peripheral border of a width of about 15 mm, i.e. identical to the peripheral border on the cathode side. The non-plated peripheral border portion of the anode side was oxidized titanium. The active cathode surface and the anode platinum plated surface each were 840 $cm^2$.

The following table lists the results obtained in Example 3, with the spacing of 2.5 mm between the adjacent electrodes, and in Example 4 with a spacing of 5 mm between adjacent electrodes.

| Current density ($A/cm^2$) | Example 3 kWh/kg (chlorine eq.) | Example 4 kWh/kg (chlorine eq.) |
|---|---|---|
| 0.05 | 5.3 | 5.2 |
| 0.10 | 4.8 | 4.9 |
| 0.15 | 4.7 | 5.3 |
| 0.20 | 4.7 | 6.1 |

EXAMPLE 5

The same experiments were conducted employing a single drawer 12 instead of two drawers as in Examples 1–4. The same specific consumptions were obtained with one drawer, the concentrations of the solutions obtained being one half, allowing for measurement errors, as compared with solutions obtained employing two drawers operating hydraulically in series.

By comparing the results of the examples, it will be apparent that a substantial improvement in specific consumption is obtained when electrodes according to the present invention are employed.

Although the present invention has been described and illustrated with respect to preferred arrangements thereof, it is to be understood that such arrangements are intended to be exemplary only, and that various modifications of form, proportions and arrangements will be apparent to those skilled in the art, without departing from the scope of the present invention.

What I claim is:

1. A bipolar electrode electrolysis apparatus, particularly for the electrolysis of saline solutions, said apparatus comprising:

a frame formed of an electrically insulating material, said frame comprising a parallelepidedal enclosure defining therein a plurality of compartments, each said compartment having an open side through one wall of said frame;

monopolar terminal electrodes mounted in said frame for connection to current leads;

a plurality of bipolar electrodes; and means for supporting said bipolar electrodes within each said compartment and for allowing removal and insertion of said bipolar electrodes through said open side.

2. An apparatus as claimed in claim 1, wherein said compartments are vertically spaced within said enclosure.

3. An apparatus as claimed in claim 1, further comprising a cover removably attachable to said one wall of said frame selectively to close said open side of said compartment and to open said open side and allow removal therethrough of said bipolar electrodes.

4. An apparatus as claimed in claim 1, wherein said supporting means supports said bipolar electrodes at equal intervals therebetween and between said monopolar terminal electrodes.

5. An apparatus as claimed in claim 1, wherein said supporting means comprises members immovable with said frame, said members having recesses into which said bipolar electrodes are removably slidable, and said recesses being separated by projections which space said bipolar electrodes at equal intervals parallel to each other and to said monopolar terminal electrodes.

6. An apparatus as claimed in claim 6, wherein said members are formed of an electrically insulating material.

7. A bipolar electrode electrolysis apparatus, particularly for the electrolysis of saline solutions, said apparatus comprising:

a frame formed of an electrically insulating material;

monopolar terminal electrodes mounted in said frame for connection to current leads;

said frame having therein at least one compartment having an open side through one wall of said frame;

a plurality of bipolar electrodes; and means for supporting said bipolar electrodes within said compartment and for allowing removal and insertion of said bipolar electrodes through said open side, said supporting means comprising a box-shaped drawer movably insertable into and removable from said compartment through said open side thereof, said drawer having spaced front and rear walls having therein grooves having closed lower ends and open upper ends, said bipolar electrodes being insertable into and removable from said grooves through said open upper ends thereof when said drawer is removed from said compartment.

8. An apparatus as claimed in claim 7, wherein said drawer is slidably movable into and from said compartment along rails on spaced side walls of said frame.

9. An apparatus as claimed in claim 7, further comprising a cover fixed to said drawer and facilitating movement thereof into and from said compartment, said cover hermetically sealing said compartment when said drawer is positioned within said compartment.

10. An apparatus as claimed in claim 7, wherein said drawer is formed of an electrically insulating material.

11. An apparatus as claimed in claim 7, further comprising shunt means providing electrical connection between the monopolar terminal cathode of said drawer and the corresponding current lead on said frame.

12. An apparatus as claimed in claim 11, further comprising means for connecting said shunt means to a control cabinet to enable continuous monitoring of the operation of said bipolar electrodes.

13. A bipolar electrode electrolysis apparatus, particularly for the electrolysis of saline solutions, said apparatus comprising:

a frame formed of an electrically insulating material;

monopolar terminal electrodes mounted in said frame for connection to current leads;

said frame having therein at least one compartment having an open side through one wall of said frame;

a plurality of bipolar electrodes, each said bipolar electrode comprising a titanium body having anode and cathode faces, said anode faces including a center portion covered with platinum and a peripheral border portion of oxidized titanium, and said cathode face including a peripheral border portion of the same width as said peripheral border portion of said anode face and covered with an electrically insulating material; and means for supporting said bipolar electrodes within said compartment and for allowing removal and insertion of said bipolar electrodes through said open side.

* * * * *